US009888772B2

(12) United States Patent
Quinto et al.

(10) Patent No.: US 9,888,772 B2
(45) Date of Patent: Feb. 13, 2018

(54) STORAGE RACK SYSTEM

(71) Applicants: Elmer Quinto, Fresno, CA (US); Humberto Almaguer, Fresno, CA (US)

(72) Inventors: Elmer Quinto, Fresno, CA (US); Humberto Almaguer, Fresno, CA (US)

( * ) Notice: Subject to any disclaimer, the term of this patent is extended or adjusted under 35 U.S.C. 154(b) by 0 days.

(21) Appl. No.: 15/211,811

(22) Filed: Jul. 15, 2016

(65) Prior Publication Data

US 2018/0014642 A1 Jan. 18, 2018

(51) Int. Cl.

| | |
|---|---|
| ***A47F 7/00*** | (2006.01) |
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47B 81/00*** | (2006.01) |
| ***A47B 46/00*** | (2006.01) |
| ***A47B 63/06*** | (2006.01) |

(52) U.S. Cl.

CPC ..... *A47B 81/005* (2013.01); *A47B 43/006* (2013.01); *A47B 46/005* (2013.01); *A47B 63/067* (2013.01); *A47F 5/0892* (2013.01); *A47F 7/0035* (2013.01)

(58) Field of Classification Search

CPC ..... A47B 81/005; A47B 46/005; A47B 2051/005; A47B 43/006; A47B 51/00; A47B 63/067; A01K 97/08; A01K 97/10; A47F 5/08; A47F 7/0221; A47F 7/0028; A47F 7/0035; A47F 5/0892; B60R 9/08; B66C 23/20; B66D 3/04; B66D 1/12

USPC ..... 211/70.8, 117, 209, 207, 175; 224/405; 248/317, 329, 328, 327, 323, 332

See application file for complete search history.

(56) References Cited

U.S. PATENT DOCUMENTS

| | | | | | |
|---|---|---|---|---|---|
| 527,870 | A * | 10/1894 | Meslein | A43D 117/00 | 211/198 |
| 593,186 | A * | 11/1897 | Baker | A47B 46/005 | 211/117 |
| 674,673 | A * | 5/1901 | Dauber | A47B 46/005 | 211/117 |
| 803,274 | A * | 10/1905 | Deaver | A47B 46/005 | 211/117 |
| 1,202,166 | A * | 10/1916 | Corbett | A47B 46/005 | 211/117 |
| 1,663,297 | A * | 3/1928 | Fruehauf | D06F 57/125 | 211/117 |
| 3,376,614 | A | 4/1968 | Stahl, Jr. | | |
| 3,872,972 | A * | 3/1975 | Cummins | B62H 3/02 | 211/117 |
| 4,003,612 | A * | 1/1977 | Munsell | A01K 97/08 | 211/70.8 |

(Continued)

*Primary Examiner* — Jennifer E. Novosad

(57) ABSTRACT

A storage rack system includes a horizontal support surface. A rack is hingedly coupled to the horizontal support surface. The rack is selectively positioned in a stored position having the rack being coextensive with the horizontal support surface. The rack is positioned in a deployed position having the rack extending downwardly from the horizontal support surface. Thus, the rack is accessible. Thee rack stores a plurality of fishing rods. A pulley unit is coupled between the horizontal support surface and the rack. Thus, the pulley unit may be manipulated. The pulley unit selectively urges the rack between the stored position and the deployed position.

14 Claims, 5 Drawing Sheets

(56) References Cited

U.S. PATENT DOCUMENTS 4,014,466 A * 3/1977 Wess ..... A01K 97/08 211/70.8
4,170,801 A 10/1979 Ward
4,424,907 A * 1/1984 Robb ..... A47B 81/005 211/118
4,696,122 A * 9/1987 Van Der Zyl ..... A01K 97/08 211/70.8
4,881,674 A * 11/1989 Medianik ..... B60R 5/006 211/70.8
5,094,351 A * 3/1992 Barney ..... A47B 81/005 211/117
5,240,128 A * 8/1993 Ohm ..... D06F 57/04 211/119.01
5,366,098 A * 11/1994 Henry ..... A47B 81/005 211/105.1
5,460,280 A * 10/1995 Feddeler ..... A47B 46/005 211/116
5,474,189 A * 12/1995 Peterson ..... B62H 3/12 211/17
5,487,475 A * 1/1996 Knee ..... A47G 25/005 211/70.8
5,664,687 A * 9/1997 Liatti ..... B62H 3/12 211/118
5,871,070 A * 2/1999 Contreras ..... B66D 1/04 187/263
5,954,410 A * 9/1999 Noellert ..... A47B 46/005 312/242
5,979,102 A 11/1999 Sagryn
6,149,020 A * 11/2000 Gumpel ..... D06F 57/125 211/119.01
6,276,539 B1 * 8/2001 Richbourg ..... A47B 81/005 160/327
6,572,168 B1 * 6/2003 Radstake ..... B60R 7/14 224/311
6,910,592 B1 * 6/2005 Lindenmeyer ..... A47B 81/005 211/60.1
7,246,865 B1 * 7/2007 Merrell, II ..... A47B 46/005 312/248
7,325,785 B2 * 2/2008 Krengel ..... A47B 5/00 211/17
7,896,206 B2 * 3/2011 Myron ..... B60R 9/055 211/17
8,136,897 B2 * 3/2012 Mascari ..... A47B 46/005 16/342
8,468,745 B2 * 6/2013 Krause ..... B62H 3/00 211/117
8,636,155 B2 1/2014 Kern
D699,477 S 2/2014 Allen
D728,261 S * 5/2015 Hicks ..... D6/552
2003/0164347 A1 * 9/2003 Bouvier, Jr. ..... A47B 43/006 211/117
2004/0050807 A1 * 3/2004 Cheng ..... B62H 3/12 211/17
2006/0255701 A1 * 11/2006 Verneuille ..... A47B 51/00 312/319.6
2010/0108627 A1 * 5/2010 Lupinacci ..... A47B 46/005 211/116
2011/0278524 A1 * 11/2011 Paredes ..... A01K 97/10 254/93 R
2011/0315642 A1 * 12/2011 Gubbrud ..... A47G 25/02 211/1.57
2014/0252930 A1 * 9/2014 Reid ..... A47B 46/005 312/247
2016/0143437 A1 * 5/2016 Gabriel ..... A47B 81/005 224/153

* cited by examiner

STORAGE RACK SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98.

The disclosure and prior art relates to rack devices and more particularly pertains to a new rack device for storing fishing rods on a ceiling.

BRIEF SUMMARY OF THE INVENTION

An embodiment of the disclosure meets the needs presented above by generally comprising a horizontal support surface. A rack is hingedly coupled to the horizontal support surface. The rack is selectively positioned in a stored position having the rack being coextensive with the horizontal support surface. The rack is positioned in a deployed position having the rack extending downwardly from the horizontal support surface. Thus, the rack is accessible. Thee rack stores a plurality of fishing rods. A pulley unit is coupled between the horizontal support surface and the rack. Thus, the pulley unit may be manipulated. The pulley unit selectively urges the rack between the stored position and the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
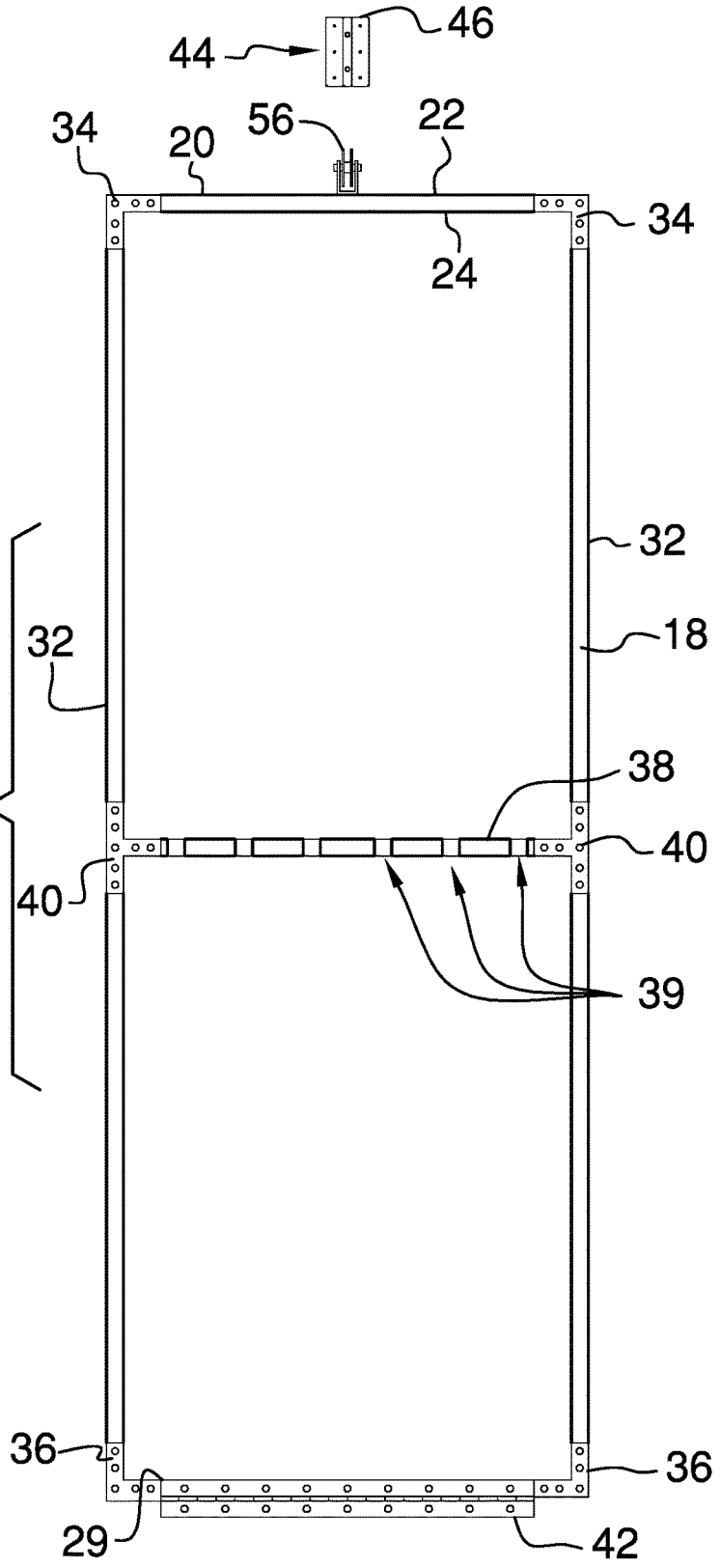
FIG. 1 is a top perspective view of a storage rack system according to an embodiment of the disclosure.
Figure 2:
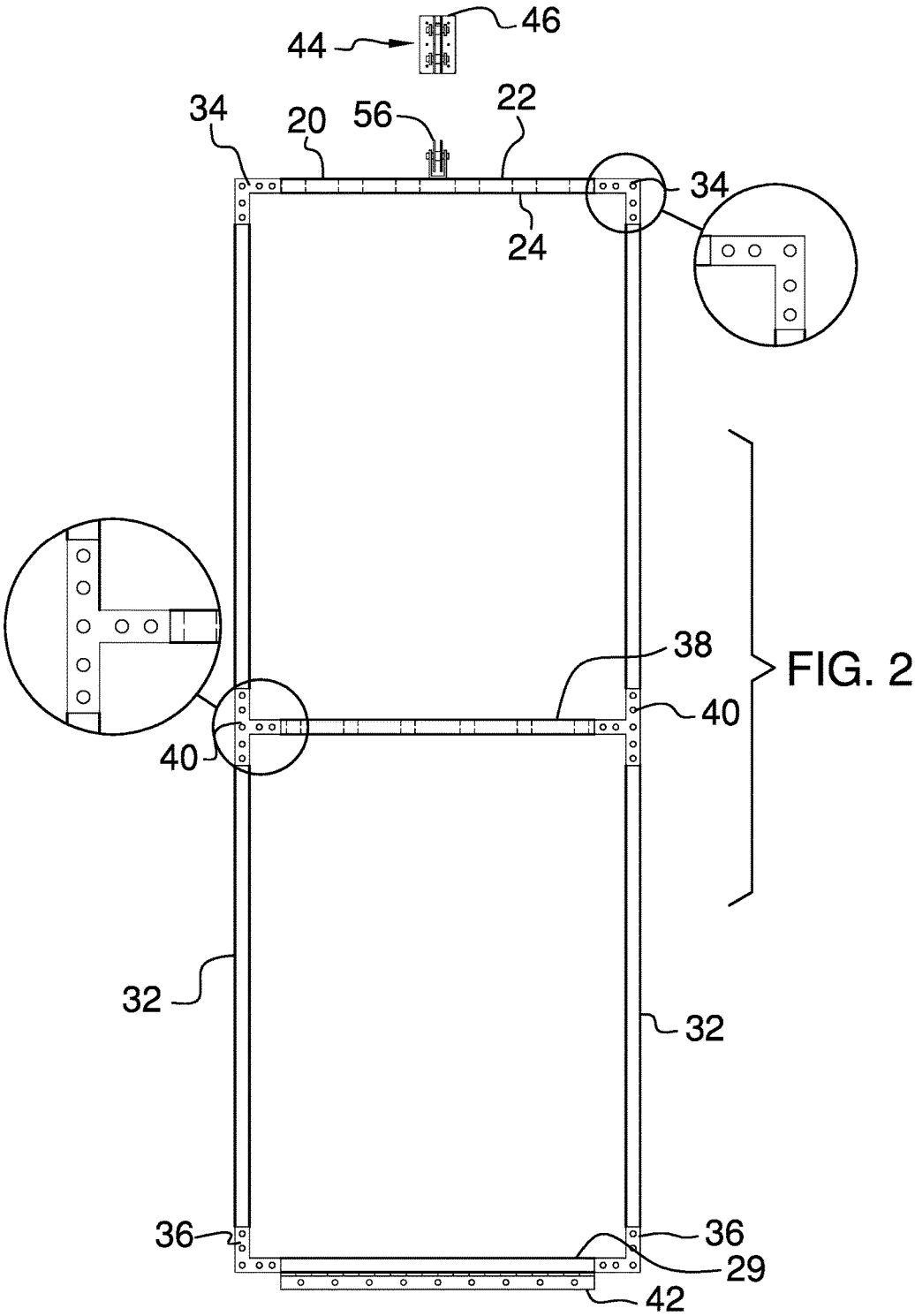
FIG. 2 is a top view of an embodiment of the disclosure.
Figure 3:
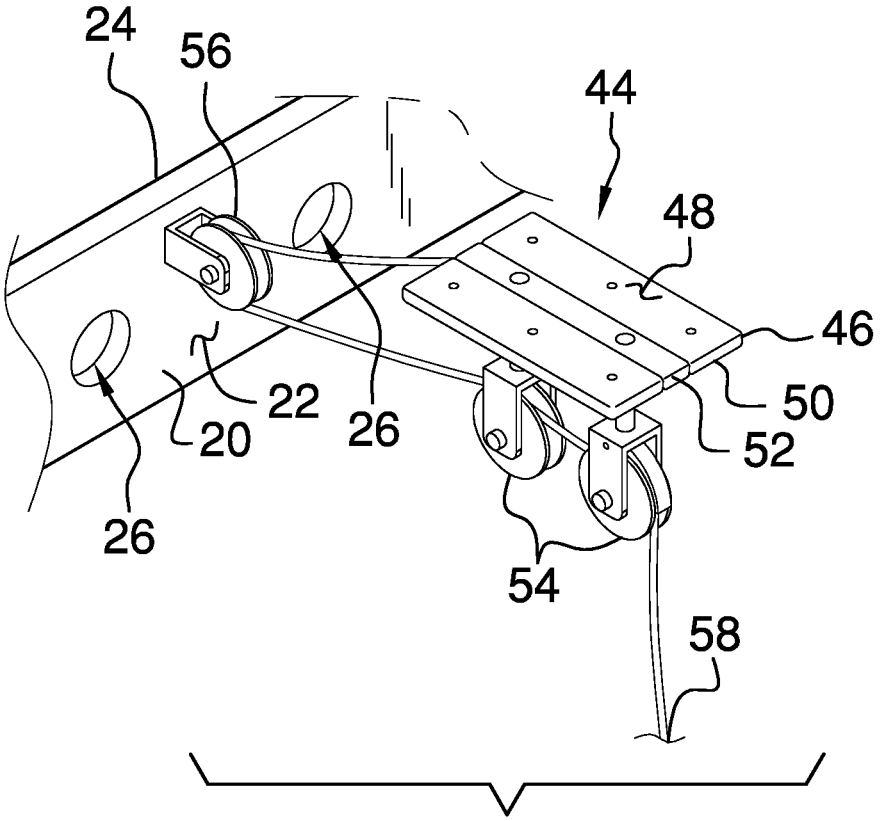
FIG. 3 is a perspective view of a pulley unit of an embodiment of the disclosure.
Figure 4:
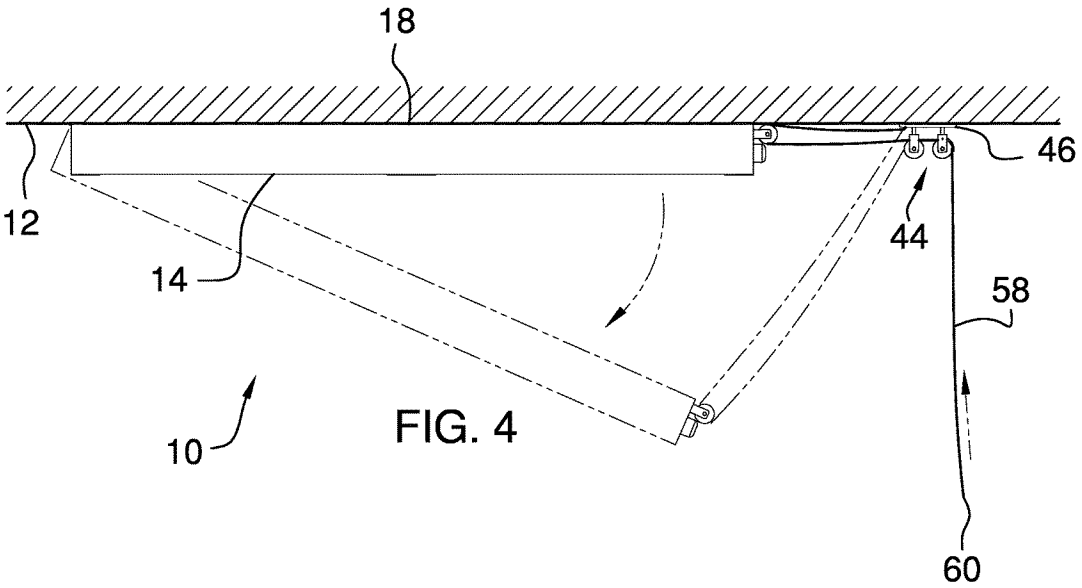
FIG. 4 is a perspective in-use view of an embodiment of the disclosure.
Figure 5:
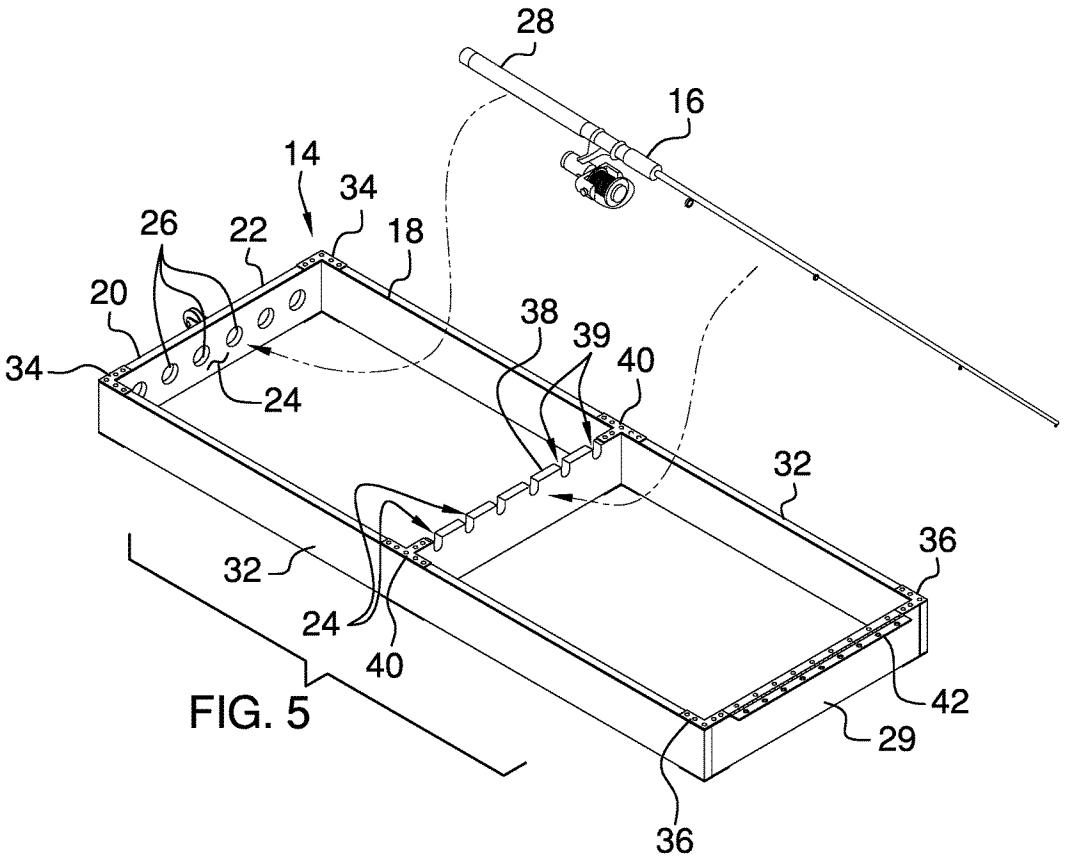
FIG. 5 is an exploded perspective view of an embodiment of the disclosure.

With reference now to the drawings, and in particular to FIGS. 1 through 5 thereof, a new rack device embodying the principles and concepts of an embodiment of the disclosure and generally designated by the reference numeral 10 will be described.

As best illustrated in FIGS. 1 through 5, the storage rack system 10 generally comprises a horizontal support surface 12. The horizontal support surface 12 may be a ceiling that is spaced from a floor. The ceiling may be a ceiling in a room or the like.

A rack 14 is hingedly coupled to the horizontal support surface 12 and the rack 14 is selectively positioned in a stored position. Thus, the rack 14 is coextensive with the horizontal support surface 12. The rack 14 is positioned in a deployed position to extend downwardly from the horizontal support surface 12. The rack 14 is accessible to a user when the rack 14 is in the deployed position. The rack 14 may store a plurality of fishing rods 16. The rack 14 has a first edge 18 and the first edge 18 abuts the horizontal support surface 12 when the rack 14 is positioned in the stored position.

The rack 14 comprises a first member 20 that has a first surface 22 and a second surface 24. The first member 20 has a plurality of apertures 26 extending therethrough. Thus, each of the apertures 26 may receive a handle 28 of an associated one of the fishing rods 16. The apertures 26 are spaced apart from each other and are distributed along the first member 20.

A second member 29 is provided that has a primary surface 30. A pair of third members 32 is provided. Each of the third members 32 is coupled to and extends between the first member 20 and the second member 29. The third members 32 are spaced apart from each other such that the rack 14 has a rectangular shape.

A pair of first fasteners 34 is provided. Each of the first fasteners 34 engages the first member 20 and an associated one of the third members 32. Thus, the first member 20 is retained on each of the third members 32. A pair of second fasteners 36 is provided. Each of the second fasteners 36 engages the second member 29 and an associated one of the third members 32. Thus, the second member 29 is retained on each of the third members 32. Each of the first fasteners 34 and the second fasteners 36 may comprise an L-bracket or the like.

A medial member 38 is provided. The medial member 38 is coupled to and extends between each of the third members 32. The medial member 38 is centrally positioned between the third members 32. The first edge 18 corresponding to the medial member 38 has a plurality of channels 39 extending downwardly therein. Each of the channels 39 may receive an associated one of the fishing rods 16. The channels 39 are spaced apart from each other and are distributed along the medial member 38. Moreover, each of the channels 39 is aligned with an associated one of the apertures 26 in the first member 20.

A pair of third fasteners 40 is provided. Each of the third fasteners 40 engages the medial member 38 and an associated one of the third members 32. Thus, the medial member 38 is retained on the third members 32. Each of the third fasteners 40 may comprise a T-bracket or the like.

A hinge 42 is provided. The hinge 42 is coupled to the first edge 18 corresponding to the second member 29. The hinge 42 is coupled to the horizontal support surface 12. Thus, the rack 14 is hingedly coupled to the horizontal support surface 12.

A pulley unit 44 is provided. The pulley unit 44 is coupled between the horizontal support surface 12 and the rack 14. Thus, the pulley unit 44 may be manipulated. The pulley unit 44 selectively urges the rack 14 between the stored position and the deployed position.

The pulley unit 44 comprises a plate 46 that has a first surface 48, a second surface 50 and a peripheral edge 52. The first surface 48 is coupled to the horizontal support surface 12. A pair of first pulleys 54 is provided. Each of the first pulleys 54 is coupled to the second surface 50 of the plate 46. The first pulleys 54 are aligned with each other. A second pulley 56 is provided. The second pulley 56 is coupled to the first surface 22 of the first member 20. The second pulley 56 is aligned with each of the first pulleys 54 when the rack 14 is in the stored position.

A rope 58 is coupled to the peripheral edge of the plate 46. The rope 58 has a distal end 60 with respect to the plate 46. The rope 58 extends through the second pulley 56 and each of the first pulleys 54. Thus, the distal end 60 may be manipulated thereby facilitating the rack 14 to be urged between the stored position and the deployed position.

In use, the rack 14 is positioned in the deployed positioned. Each of the fishing rods 16 is positioned in the rack 14. Thus, the rack 14 organizes the fishing rods 16 and inhibits the fishing rods 16 from becoming tangled together. The rope 58 is pulled to urge the rack 14 in to the deployed position. The rope 58 is secured to an anchor to retain the rack 14 in the deployed position. Thus, the rack 14 does not occupy floor space when the fishing rods 16 are stored. The rope 58 is released from the anchor and the rack 14 is lowered into the deployed position to access the fishing rods 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A storage rack system being configured to store a plurality of fishing rods, said system comprising a horizontal support surface;

a rack being hingedly coupled to said horizontal support surface, said rack being selectively positioned in a stored position having said rack being coextensive with said horizontal support surface, said rack being positioned in a deployed position having said rack extending downwardly from said horizontal support surface wherein said rack is configured to be accessible, said rack being configured to store a plurality of fishing rods, said rack having a first edge, said first edge being planar, said first edge abutting said horizontal support surface when said rack is positioned in said stored position;

a hinge being coupled to said first edge of said rack, said hinge being coupled directly to said horizontal support surface such that said rack is hingedly coupled to said horizontal support surface; and a pulley unit being coupled between said horizontal support surface and said rack wherein said pulley unit is configured to be manipulated, said pulley unit selectively urging said rack between said stored position and said deployed position.

2. The system according to claim 1, wherein said rack comprises a first member having a first surface and a second surface, said first member having a plurality of apertures extending therethrough wherein each of said apertures is configured to receive a handle of an associated one of the fishing rods, said apertures being spaced apart from each other and being distributed along said first member.

3. The system according to claim 2, further comprising a second member having a primary surface.

4. The system according to claim 3, further comprising a pair of third members, each of said third members being coupled to and extending between said first member and said second member, said third members being spaced apart from each other such that said rack has a rectangular shape.

5. The system according to claim 4, further comprising a pair of first fasteners, each of said first fasteners engaging said first member and an associated one of said third members such that said first member is retained on each of said third members.

6. The system according to claim 4, further comprising a pair of second fasteners, each of said second fasteners engaging said second member and an associated one of said third members such that said second member is retained on each of said third members.

7. The system according to claim 4, further comprising a medial member being coupled to and extending between each of said third members, said medial member being centrally positioned between said first member and said second member.

8. The system according to claim 7, wherein said first edge corresponding to said medial member has a plurality of channels extending downwardly therein wherein each of said channels is configured to receive an associated one of the fishing rods, said channels being spaced apart from each other and being distributed along said medial member, each of said channels being aligned with an associated one of said apertures in said first member.

9. The system according to claim 7, further comprising a pair of third fasteners, each of said third fasteners engaging said medial member and an associated one of said third members such that said medial member is retained on said third members.

10. The system according to claim 4, further comprising said hinge being coupled to said first edge corresponding to said second member.

11. The system according to claim 1, wherein said pulley unit comprises:

a plate having a first surface, a second surface and a peripheral edge, said first surface being coupled to said horizontal support surface; and a pair of first pulleys, each of said first pulleys being coupled to said second surface of said plate, said first pulleys being aligned with each other.

12. The system according to claim 11, further comprising:

said rack including a first member having a first surface; and a second pulley being coupled to said first surface of said first member, said second pulley being aligned with each of said first pulleys when said rack is in said stored position.

13. The system according to claim 12, further comprising a rope being coupled to said peripheral edge of said plate, said rope having a distal end with respect to said plate, said rope extending through said second pulley and each of said first pulleys wherein said distal end is configured to be manipulated thereby facilitating said rack to be urged between said stored position and said deployed position.

14. A storage rack system being configured to store a plurality of fishing rods, said system comprising a horizontal support surface;

a rack being hingedly coupled to said horizontal support surface, said rack being selectively positioned in a stored position having said rack being coextensive with said horizontal support surface, said rack being positioned in a deployed position having said rack extending downwardly from said horizontal support surface wherein said rack is configured to be accessible, said rack being configured to store a plurality of fishing rods, said rack having a first edge, said first edge abutting said horizontal support surface when said rack is positioned in said stored position, said rack comprising:

a first member having a first surface and a second surface, said first member having a plurality of apertures extending therethrough wherein each of said apertures is configured to receive a handle of an associated one of the fishing rods, said apertures being spaced apart from each other and being distributed along said first member, a second member having a primary surface, a pair of third members, each of said third members being coupled to and extending between said first member and said second member, said third members being spaced apart from each other such that said rack has a rectangular shape, a pair of first fasteners, each of said first fasteners engaging said first member and an associated one of said third members such that said first member is retained on each of said third members, a pair of second fasteners, each of said second fasteners engaging said second member and an associated one of said third members such that said second member is retained on each of said third members, a medial member being coupled to and extending between each of said third members, said medial member being centrally positioned between said first member and said second member, said first edge corresponding to said medial member having a plurality of channels extending downwardly therein wherein each of said channels is configured to receive an associated one of the fishing rods, said channels being spaced apart from each other and being distributed along said medial member, each of said channels being aligned with an associated one of said apertures in said first member, a pair of third fasteners, each of said third fasteners engaging said medial member and an associated one of said third members such that said medial member is retained on said third members, a hinge being coupled to said first edge corresponding to said second member, said hinge being coupled to said horizontal support surface such that said rack is hingedly coupled to said horizontal support surface; and a pulley unit being coupled between said horizontal support surface and said rack wherein said pulley unit is configured to be manipulated, said pulley unit selectively urging said rack between said stored position and said deployed position, said pulley unit comprising:

a plate having a first surface, a second surface and a peripheral edge, said first surface being coupled to said horizontal support surface, a pair of first pulleys, each of said first pulleys being coupled to said second surface of said plate, said first pulleys being aligned with each other, a second pulley being coupled to said first surface of said first member, said second pulley being aligned with each of said first pulleys when said rack is in said stored position, and a rope being coupled to said peripheral edge of said plate, said rope having a distal end with respect to said plate, said rope extending through said second pulley and each of said first pulleys wherein said distal end is configured to be manipulated thereby facilitating said rack to be urged between said stored position and said deployed position.

* * * * *